United States Patent [19]

Davis

[11] Patent Number: 4,909,512

[45] Date of Patent: Mar. 20, 1990

[54] GAME APPARATUS UTILIZING ROLLING MEMBERS

[76] Inventor: Shelton D. Davis, 2804 Fannin Ave., Midland, Tex. 79705

[21] Appl. No.: 92,317

[22] Filed: Sep. 2, 1987

[51] Int. Cl.[4] ..... A63B 67/14; A63F 9/06; A63D 3/00

[52] U.S. Cl. ..... 273/109; 273/153 R; 273/118 R; 273/115

[58] Field of Search ..... 273/109, 113, 118 R, 273/153 R, 123 R, 115, 108

[56] References Cited

U.S. PATENT DOCUMENTS

| | | | |
|---|---|---|---|
| 424,667 | 4/1890 | Bixler . | |
| 584,784 | 6/1897 | Kemper | 273/153 R |
| 601,924 | 4/1898 | Wilson . | |
| 604,248 | 5/1898 | Hopley . | |
| 876,820 | 1/1908 | Maltbie | 273/153 R |
| 1,154,136 | 9/1915 | Simao | 273/153 R |
| 2,467,781 | 4/1949 | Ribbe | 273/153 R |
| 2,665,915 | 1/1954 | Steig | 273/109 |
| 3,135,512 | 6/1964 | Taylor | 273/109 |
| 3,706,457 | 12/1972 | Gonzales et al. . | |
| 3,887,185 | 6/1975 | Landreville | 273/109 |
| 3,901,510 | 8/1975 | Demaio | 273/113 |
| 4,413,823 | 11/1983 | Breslow | 273/113 |
| 4,557,482 | 12/1985 | Wharton | 273/109 |

FOREIGN PATENT DOCUMENTS 2835242 2/1980 Fed. Rep. of Germany ..... 273/109

*Primary Examiner*—William H. Grieb
*Assistant Examiner*—Gary Jackson
*Attorney, Agent, or Firm*—Pravel, Gambrell, Hewitt, Kimball & Krieger

[57] ABSTRACT

A toy game educational and/or therapeutic possibilities comprising a translucent or transparent elongated cylindrical member having a hollow extending longitudinally through the member and a partition disposed in the hollow which extends radially between the interior walls of the member and along the elongated length of the member which divides the hollow into a pair of elongated, parallel but separated spaces. An end cap is included on each end of the cylindrical member which encloses the hollow and a plurality of distinct balls clearly disposed in a random order in at least one of the spaces of the hollow for rolling movement along the elongated length of the cylindrical member between the partition and the curved wall of the cylindrical member. At least one portal is included in the partition which is an opening having a dimension greater than the diameter of the balls and which is located between the ends of the cylindrical member which communicates the separated spaces whereby by manipulation of the elongated member, the balls may be moved linearly along a length of the partition and through the portal from one space to its parallel but separated space and hence from their random order to an ordered arrangement.

11 Claims, 1 Drawing Sheet

GAME APPARATUS UTILIZING ROLLING MEMBERS

BACKGROUND OF THE INVENTION

1. Field of the Invention

The present invention relates to a game apparatus and other uses. More particularly, the present invention relates to a game wherein a plurality of rolling members are positioned in a dual chambered tube so that the numbered members may be motivated to be arranged from a recognizably random distribution to a recognizably consecutive distribution for a solution to the game.

2. General Background

There have been numerous games on the market which have as their solution the movement of balls or other types of elements, at random order to a consecutive order, for example numerical. Based upon this basic premise, other types of games on the market, the most famous being the "Rubix Cube", adopt the manipulation of the game elements to a sequential colored pattern on faces of the cube. Although games such as Rubix Cube do attempt to provide a mechanical problem to be solved, they do not address the concept of free movement of spheres, contained in a bi-chambered tube, wherein openings strategically positioned between the chambers allows movement of the spheres between the chambers n such a fashion that skill in the manipulation of the tube and the movement of the balls between the chambers will result in the balls moving from a random order in a chamber to a consecutive order in the second chamber.

The following patents are listed for convenience as pertinent art found, but applicant is submitting herewith a detailed explanation in the Prior Art Statement for discussion of the patents cited herein:

| PATENT NO | INVENTOR | TITLE |
|---|---|---|
| 4,413,823 | Breslow | "Ball Puzzle" |
| 3,887,185 | Landreville | "Tilting tube With Rolling Member Game" |
| 3,706,457 | Gonzales, et al | "Game Having Captured Marble Exposed For Digital Manipulation" |
| 604,248 | Hopley, et al | "Puzzle" |
| 601,924 | Wilson | "Toy Or Puzzle" |
| 424,667 | Bixler | "Game Board" |

SUMMARY OF THE PRESENT INVENTION

The apparatus of the present invention solves the problems in the art in a simple and straightforward manner. What is provided is a transparent elongated cylindrical tube having a space extending longitudinally through the tube, and includes a partition or wall disposed in the space extending radially between the annular wall of the member and situated along the length of the member dividing the space into a pair of elongated, parallel but separate spaces along its length. There is further included a plurality of distinct balls disposed in at least one of the space lengths for rolling movement along the elongated length of the cylinder between the partition and the curved annular wall of the tube. There is further included a single configured opening in the face of the partition allowing communication between the spaces and accommodating the balls therethrough. Further, there is included, a pair of openings in the partition at either end of the partition for likewise accommodating the movement of balls therethrough. The cylinder is enclosed at its end portions with a cap at each end. In the solution of the game, the balls are moved between the spaces through the openings from a recognizably random order to a recognizably consecutive order, such as but not confined to, numerical order.

Therefore, it is a principal object of the preferred embodiment of the present invention to provide a game for manipulating spheres within a tube from a random to a consecutive numerical order;

It is a further object of the present invention to provide a game wherein balls are positioned within a tube with a partition therebetween, the partition allowing communication between the spaces, so that the balls may be delivered between the spaces of random to consecutive numerical order;

It is a further object of the present invention to provide a game including a partition for allowing balls to move between either side of the partition within a tube, with the openings in the partition allowing movement of the balls on both ends of the partition when the partition is in an upright position, but not through the middle opening in the partition; and It is a further object of the present invention to provide a game which may serve as a toy, a puzzle for entertainment or diversion, an educational game, a game of testing an individual's manual dexterity, a device for testing an individual's intellect, or a device use for physical rehabilitative therapy.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
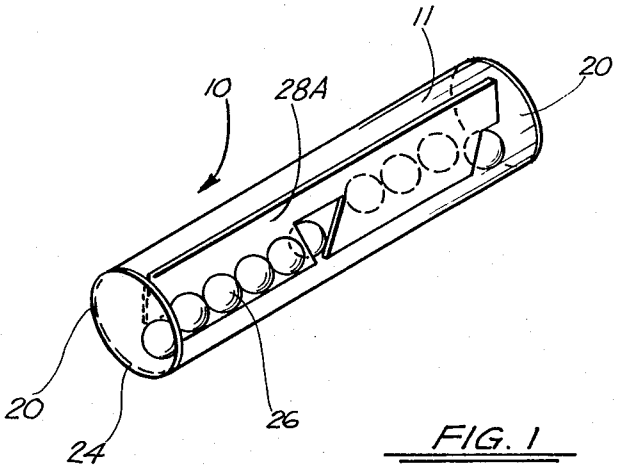
FIG. 1 is an overall perspective view of the game apparatus of the present invention.
Figure 2:
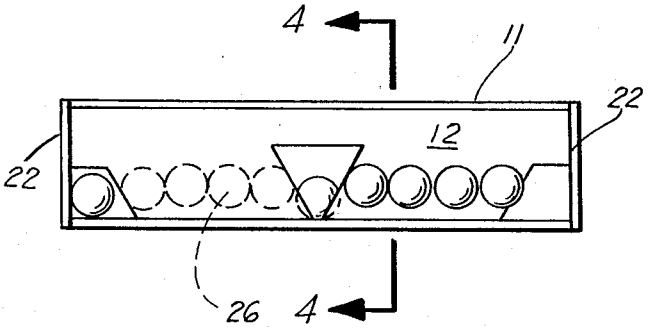
FIG. 2 is a side view of the apparatus of the present invention.
Figure 5:
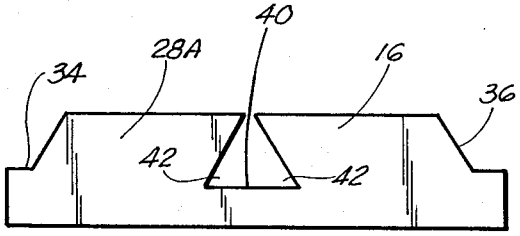
FIG. 5 is a view of the partition member which is included in the overall apparatus of the present invention.
Figure 4:
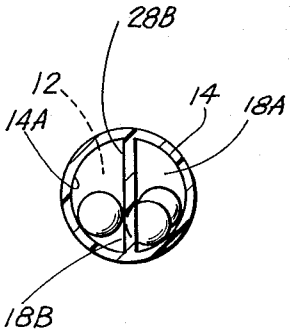
FIG. 4 is a view along lines 4—4 in FIG. 2 of the apparatus of the present invention.
Figure 3:
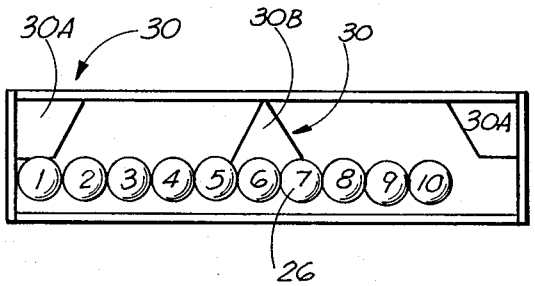
FIG. 3 is an additional side view of the apparatus of the present invention.

FIGS. 1–5 illustrate the preferred embodiment of the toy game as illustrated by the numeral 10. The toy game includes a transparent, elongated cylindrical member 11 which may be of any light weight suitable material such as a clear acrylic plastic. The cylindrical member 11 includes a hollow 12 which extends longitudinally through the cylindrical member 11. Accordingly, the cylindrical wall 14 of the cylindrical member 11 defines the hollow interior 12, and is of suitable thickness to give structural rigidity to the cylindrical member 11.

A partition 16 is longitudinally disposed in hollow 12. The partition 16 may be of any suitable light weight material such as acrylic plastic and may be either transparent, translucent, or opaque. The partition 16 is preferably located centrally along the longitudinal axis of the cylindrical member 11 and extends radially between the interior cylindrical surface 14A of wall 14 to divide the hollow interior 12 into a pair of elongated, parallel but separated similar elongated spaces 18A and 18B. On either end 20 of the cylindrical member 11, an end cap 22 is attached for enclosing hollow interior 12 and the elongated spaces 18A, 18.. The end caps 22 are of any suitable light weight material such as plastic which may be transparent, translucent, or opaque, and as shown in the Figure may be circular. The end caps 22 are fixedly attached to the circular periphery 24 of each end of the cylindrical member 11 by any suitable means such as gluing or a threaded portion which extends axially from end cap 22 and which is threadably engaged with a similarly threaded portion extending axially inward into cylindrical member 11 from the circular periphery 24 of end 20.

A plurality of distinct balls 26 are slidably disposed in the hollow interior 12. The balls 26 are preferably light weight plastic having preferably a common diameter and are disposed in at least one of the elongated spaces 18A, 18B before the end caps 22 are attached, thus enclosing the hollow interior 12 and the balls 26. Each ball 26 has a diameter which is less than the distance between the surface of the partition 16 and the interior curved surface of the cylindrical wall 14 so that the balls 26 may be disposed in the elongated spaces 18A, 18B in a state such that they are free to roll along the elongated length of the cylindrical member 11 on either side of the partition 16 between the partition 16 and the curved interior wall 14 of the cylindrical member 11.

The partition 16 is preferably felt, having a thickness which is preferably thin, and includes opposing planar surfaces 28A, 28B along the opposite sides of the partition which extend longitudinally and radially between the interior walls 14 of cylindrical member 11. Hence, partition 16 has opposed planar surfaces 28A, 28B on which the balls 26 may freely roll linearly along the elongated length of spaces 18A, 18B. Accordingly, the inside diameter of the cylindrical member 11 will be at least twice the diameter of the balls 26 and will include suitable compensation for the thickness of partition 16. A number of portals 30 are included in the partition 16. The portals 30 include a symmetrical wedge-shaped opening 30A having a dimension greater than the diameter of the balls 26 which are located in partition 16 adjacent each end 22 of the cylindrical member 11.

The openings 30A have a side 34 which has a length less than the diameter of balls 26 and which extends generally parallel to the axis of the cylindrical member 11 to intersect with the end cap 22. The openings 30A also have a substantially diagonal side 36 which extends from the end of side 34 distal its intersection with end cap 22 in a direction radially toward cylindrical surface 14A of cylindrical member 11 and away from end cap 22 to intersect with cylindrical wall 14 a distance away generally twice the length of side 34. Hence sides 3 and 36 and the interior surface 14A of cylindrical member 11 extends axially from its intersection with diagonal side 36 to intersect with end cap 22 from each opening 30A. Further, as shown in the Figures, each side 34 may be disposed between the axis of the cylindrical member 11 and the wall of the cylindrical member 11 such that the radial distance between the axis of the cylindrical member 11 and its interior wall 14A is generally at least one hundred twenty percent (120%) greater than the radial distance between side 34 and the interior wall 14A of cylindrical member 11. Thus each opening 30A allows the balls 26 when linearly aligned near the intersection of partition 16 and cylindrical wall 14, to pass through openings 30A while preventing their passing when the balls are located near or along the axis of the cylindrical member 11.

The portals 30 also include an opening 30B having sides in length generally twice the diameter of balls 26 and which is located in the partition 16 midways between the wedge-shaped openings 30A. The triangular opening 30B has a side 40 disposed parallel to the axis of cylindrical member 11. Side 40 lies near the axis of cylindrical member 11 and in consequence, opening 30B has a pair of acute angles 42 lying near the longitudinal axis of cylindrical member 11. The triangular opening 30B extends radially outward to intersect with the interior cylindrical surface 14A of cylindrical member 11. Hence opening 30B allows the walls 26 when linearly aligned near the axis of cylindrical member 11 to pass through opening 30B while effectively preventing their passing when the balls are located near the intersection of partition 16 and cylindrical wall 14.

Hence, the portals 30 communicate the separated spaces 18A and 18B, whereby the manipulation of elongated cylindrical member 11, the balls 26 may be rolled linearly between the partition 16 and the interior wall 14 of cylindrical member 11 and selectively urged through the portals 30 from one elongated space 18A or 18B to its parallel but separated space 18A or 18B. By aligning the balls 26 linearly near the elongated axis of cylindrical member 11 a ball 26 way be passed to the midpoint of its parallel but separated space, and by positioning the balls 26 near the intersection of partition 16 and cylindrical wall 14, a ball 26 may be passed through a symmetrical wedge shaped opening 30A into the end of the parallel but separated space. Hence the balls 26 may be moved from one space to its parallel but separated space, and movement of the balls 26 from one side of the partition 16 to the other is made possible by the portals 30.

The number of balls 26 may be for example, up to and including five or more. The balls 26 may have a distinct form by providing the balls 26 in a plurality of colors which may be consecutively numbered. Alternatively, the balls may be marked with only numbers or four example stripes or checks. The length of the cylindrical member 11 between the caps 22 is chosen according to the number of balls 26 which are selected, and is generally at least equal to the length of the linear alignment of the balls 26 plus an additional ball 26 diameter. Hence with the selection of five balls, the cylindrical member between the end caps 22 would generally be equal to at least six ball diameters, and with a selection of ten balls the distance between the end caps 22 would be generally at least eleven ball 26 diameters.

Further with a five ball 26 selection, an embodiment of the game 10 would have balls 26 which may for example, be numbered one through five and which may be colored red, white, blue, white and red respectively. In this embodiment a single portal would be located at the partition's midpoint and would be dimensioned similarly to triangular opening 30B. Also with ten ball 26 selection, an embodiment of the game 10 may have a basic color scheme such as a black, three red, three white and three blue balls 26. The balls 26 may also be numbered by for example, numbering the three red balls 1–3, the white balls 4–6, the blue balls 7–9 and the black ball 10.

The ordered arrangement of colors may further include for example an adjacent arrangement of all like colors. Therefore, one possible arrangement with only red and black balls would be to have all the red balls disposed linearly adjacent and all the black balls disposed linearly adjacent in an arrangement in which only one red ball would be adjacent to a black ball. An arrangement of this type having four red and three black balls would thus have four red balls aligned linearly in one end of the cylindrical member 11 and have three remaining balls aligned linearly in the other end of the cylindrical member 11.

A further arrangement of the colors could be for example, having pairs of similarly colored balls such as a pair of red balls which are separated for example, by a black ball with each black ball separating the pairs of red balls by having adjacent red balls on its flanks. An arrangement of this type having four red and three black balls would thus have a pair of adjacent red balls, a black ball, a pair of adjacent red balls and the remaining black balls distributed randomly at either end of the red balls. However, the distinct balls 26 may have other distinctive markings such as the checks and stripes which may be organized into an ordered arrangement in a similar manner as the colors to provide an ordered arrangement of markings.

Further, the distinctive markings may be a unique number such as numbering each ball individually from one to seven which are disposed randomly within the elongated spaces 18A and 18B which are moved into an ordered arrangement by manipulation of the cylindrical member 11 to provide an ordered arrangement of numbers. Accordingly, for example, the ordered arrangement of numbers may be having the balls arranged in a linear fashion so that the balls are numbered from their highest number to their lowest number consecutively, Hence, a possible arrangement would be to have the lowest numbered ball on the left with each ball increasing in number to the greatest number ball which would be positioned on the right.

Initially, the balls 26 may be distributed randomly in at least one of the elongated spaces 18A and 18B. Thereafter, by tilting rotating, tapping and shaking as described hereafter, the elongated cylindrical member 11 would be held in any suitable manner by the hands of the user and by tilting the cylindrical member 11 with respect to its longitudinal axis and shaking, tapping and rotating the cylindrical member 11 about its longitudinal axis, the balls 26 may be selectively urged through portals 30A, 30B into a selected elongated space 18A and 18B and distributed in a random or ordered alignment as described hereafter.

Exemplary dimensions for the ten ball embodiment would be a cylindrical member 11 having a length of 6.80 inches, and outside diameter of 1.75 inches and an inside diameter of 1.50 inches. The partition 16 thus has a length of 6.80 inches, a width of 1.50 inches and a thickness of 0.125 inches and may be for example red. Accordingly, the balls 26 have a diameter of 0.610 inches, the end caps 22 have a diameter of 1.75 to 1.80 inches and a thickness of 0.125 inches, the sides of triangular opening 30B which have a length of 1.220 inches, a side 34 of wedge shaped opening 30A which has a length of 0.450 inches and a side 36 which intersects with cylindrical wall 14 a distance away generally 0.90 inches.

In operation, the user would have the balls 26 distributed in one of the spaces 18A and 18B and would manipulate by tilting the elongated cylinder 11 transversely to its axis for moving the balls 26 linearly in a discrete direction along the axis of the cylindrical member 11. Consecutively with the transverse manipulation of the cylinder 11, the elongated cylinder 11 may be rotated about its axis to rotate the partition 16 from a vertical position having the balls 26 aligned linearly adjacent the intersection of the cylindrical member 11 and partition 16 to a horizontal position having the balls 26 aligned linearly near the axis of the cylindrical member 11 and along the surface of the partition.

By selective se of the tilting and rotating, a specific ball 26 may be positioned near the axis of member 10 and adjacent opening 30B. Further, any balls 26 in the other separated space 18B or 18A may be positioned adjacent opening 30B so that the suitable space exists below 30B and between the balls 26, allowing the ball positioned on partition 16 adjacent opening 30B to be urged to fall through the opening 30B by any type of motion including tilting, rotating, shaking, and tapping into the space between the balls in the separated space. Consecutively, the balls, in the other space 18A or 18B may be specifically positioned adjacent opening 30B so that the balls will have an ordered arrangement when the specific ball has fallen into the space between the spaced lower balls. An example of tilting, rotating, shaking and tapping which would be suitable for ordering the arrangement would be to have a specific ball such as a white ball numbered four located in the space above the partition and a red ball numbered three and a white ball numbered six located in the other space 18A or 18B in a spaced arrangement adjacent opening 30B so that the four ball may fall into the space between the five or six balls to form an ordered four, five, and six arrangement. Hence, the balls 26 may discretely be passed through the selected portal 30A and 30B in the partition 16 which communicates the elongated, parallel but separated spaces 18A and 18B.

This is accomplished by the rotation of cylindrical member 11 to vertically position partition 16 so that the balls 26 may lie adjacent the intersection of partition 16 with the cylindrical member 11. Manipulation of the cylinder 11 transversely to its axis in a horizontal arc may be used with minute shaking and tapping in a horizontal direction for passing a ball 26 discretely through a selected portal 30A and 30B in the partition 16 to a selected end o its parallel but separated elongated space 18A and 18B.

Rotation of cylindrical member 11 to horizontally position partition 16 allows the balls 26 to be aligned generally linearly along the upper surface of partition 16 near the axis of the cylindrical member 11. Manipulation of the cylindrical member 11 transversely to its axis in a vertical arc will cause the balls 26 to roll linearly along the axis of the cylindrical member 11 where a selected ball 26 may fall, by means of tilting, rotating, shaking and tapping, through triangular opening 30B into the separated space 18A and 18B below the partition. Consecutively with the rolling of the balls 26 along the upper surface of partition 16, the user would by consecutive manipulation of the cylinder transversely to its axis in a vertical arch selectively move the balls 26 in the separated space below the partition 16 so that a ball 26 above the partition may fall into a selected order in the elongated space 30A and 30B below the partition. Hence the balls may be arranged in a ordered arrangement by the discrete passing of the balls 26 through the portals 30A and 30B into one of the elongated spaces 18A and 18B.

The embodiment(s) described here in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed as invention is:

1. An educational toy game apparatus, comprising:

a. a transparent elongated cylindrical member having a hollow extending longitudinally through said member:

b. a partition disposed in said hollow extending between the interior walls of said member and along the elongated length of said member, said partition dividing said hollow into a pair of elongated, parallel, but separated spaces;

c. an end cap on each end of said member for enclosing said hollow and said spaces;

d. a plurality of distinct colored-coded balls freely disposed in a random order in at least one of said spaces of said hollow for rolling movement along the elongated length of said cylindrical member between said partition and the curved wall of said cylindrical member;

e. portals in said partition including a symmetrical wedge-shaped opening having a dimension greater than the diameter of said color-coded balls adjacent to each end of said cylindrical member, and a triangular opening having a dimension greater than the diameter of said balls located midway between said wedge-shaped openings, said portals communicating with said separate spaces whereby by manipulation of the elongated member said color-coded balls may be moved linearly along a length of said partition and through said portals from one space to its parallel but separated space and hence from their random order to an ordered predetermined color-coded arrangement.

2. The toy game in claim 1, wherein said distinct balls have a plurality of colors, and wherein said ordered arrangement is an ordered arrangement of colors.

3. The toy game in claim 2, wherein said ordered arrangement of colors includes an adjacent arrangement of all like colors.

4. The toy game in claim 1, wherein said triangular opening is an equilateral triangular opening having sides which are, in length, generally twice the diameter of said balls.

5. The toy game of claim 1, wherein said triangular opening has a pair of angles lying near the longitudinal axis of said member and its remaining acute angle intersecting the interior wall of said member.

6. The toy game of claim 1, wherein said wedge-shaped openings have an edge disposed parallel but spaced from an equilateral edge of said equilateral triangular opening which intersects with the interior wall of said member.

7. A same apparatus, comprising:

a. a transparent elongated cylindrical member having a hollow extending longitudinally through said member;

b. a situated partition disposed in said hollow extending radially between the interior walls of said member and along the elongated length of said member, said partitioned dividing said hollow into a pair of elongated, parallel but separated spaces;

c. an end cap on each end of said member for enclosing said hollow and said spaces;

d. a plurality of distinct numbered balls freely disposed in a random order in at least one of said spaces of said hollow for rolling movement along the elongated length of said cylindrical member between said partition and the curved wall of said cylindrical member;

e. a first opening having a dimension greater than the diameter of said numbered balls, said opening being located midway between the ends of said cylindrical member and in communication with said separated spaces, and second and third openings, one opening at each end of said partition for also allowing movement of the balls between the separated spaces, whereby by manipulation and rotation of the elongated member about its longitudinal axis to a position having the partition generally horizontal, said balls may be moved linearly along a length of said partition and through said openings from one space to its parallel but separated space and hence arranged from their random numbered order to a consecutive numbered arrangement.

8. The toy game in claim 7 wherein said distinct balls have a distinctive marking, and wherein said ordered arrangement is an ordered arrangement of markings.

9. The toy game in claim 7, wherein said ordered arrangement of numbers is consecutive from its highest number to its lowest number.

10. The toy game in claim 1, wherein the inside diameter of said cylindrical member is twice the diameter of said balls.

11. A method of disposing a plurality of numbered or color-coded balls in an ordered arrangement from a random state, comprising the steps of:

a. having the numbered or color-coded balls disposed in a closed cylinder in a random, generally linear arrangement adjacent a partition centrally located in the cylindrical and extending between the walls of the cylinder for separating the cylinder into elongated, parallel but separated spaces;

b. tilting the cylinder transversely to the longitudinal axis for moving the numbered or color-coded balls linearly in a discrete direction along or parallel to the axis of the cylinder;

c. rotating the elongated cylinder about its longitudinal axis to rotate the partition from a vertical position having the numbered or color-coded balls aligned linearly adjacent the intersection of the cylindrical member and the partition for passing a ball through the portals in said partition adjacent the intersection of the cylindrical member and the partition to a horizontal position having the balls aligned linearly near the axis of the cylindrical member for passing a ball through a portal in said partition having its opening substantially near the axis of the cylindrical member;

d. passing the numbered or color-coded balls discretely through a selected portal in said partition communicating the elongated, parallel but separated spaces by the rotating and the linear motion of the balls along a discrete direction from the tilting; and e. arranging the numbered or color-coded balls in an ordered numerical or previously determined color-coded arrangement by the discrete passing of the balls through the portals into one of the elongated spaces.

* * * * *